United States Patent [19]

Pearce, Jr.

[11] 3,995,626

[45] Dec. 7, 1976

[54] CONNECTOR DEVICE FOR BREATHING APPARATUS

[76] Inventor: Fredric C. Pearce, Jr., Box 186-A, Rte. 1, Winter Garden, Fla. 32787

[22] Filed: June 20, 1975

[21] Appl. No.: 588,889

[52] U.S. Cl. ..... 128/142.2; 137/608; 251/149.4

[51] Int. Cl.[2] ..... A62B 7/04

[58] Field of Search ..... 128/142, 142.2; 137/608, 614.21; 251/149.4

[56] References Cited

UNITED STATES PATENTS

| | | | |
|---|---|---|---|
| 2,345,140 | 3/1944 | McCollum et al. | 137/608 X |
| 3,238,943 | 3/1966 | Holley | 128/142.2 |
| 3,462,117 | 8/1969 | Lind | 137/608 X |

FOREIGN PATENTS OR APPLICATIONS

| | | | |
|---|---|---|---|
| 1,314,794 | 12/1962 | France | 128/142 |
| 735 | 12/1910 | United Kingdom | 251/149.4 |

*Primary Examiner*—Alan Cohan
*Assistant Examiner*—Gerald A. Michalsky
*Attorney, Agent, or Firm*—Cushman, Darby & Cushman

[57] ABSTRACT

The disclosure embraces a connecting tee for use with a contained air supply to enable two or more individuals to draw air from the supply and includes a chamber having one passage connected to a source of air, a first passageway with a one-way check valve for supplying air to a first user and a second passageway which is provided with a pair of one way check valves; the first valve of the second passage permits air flow out of the connector from the source but prevents inflow of external air; the second check valve of the second passageway is normally in a closed position but is manually opened where a second user must establish communication with the source of air carried by the first user.

6 Claims, 7 Drawing Figures

Fig. 1
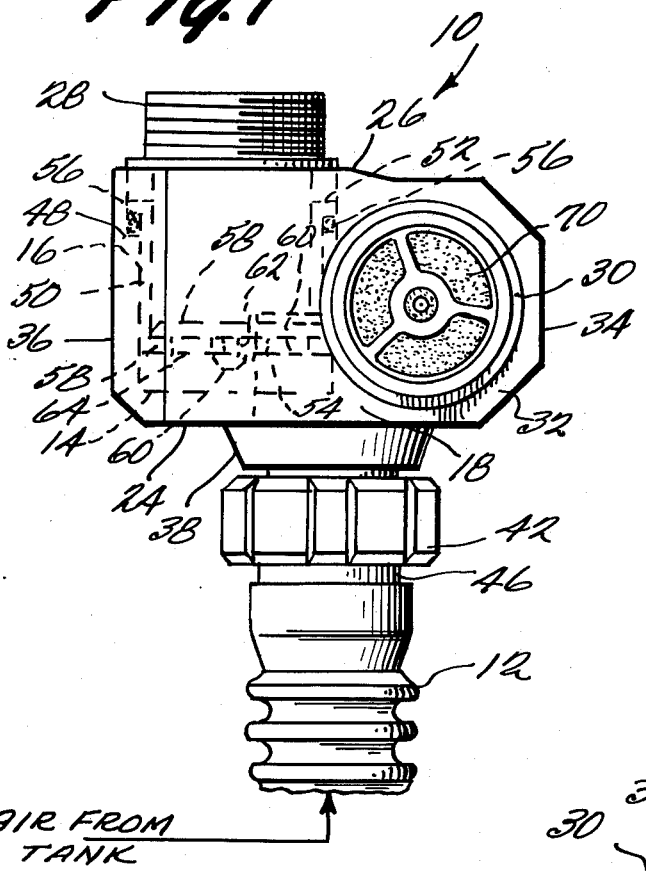
Fig. 2
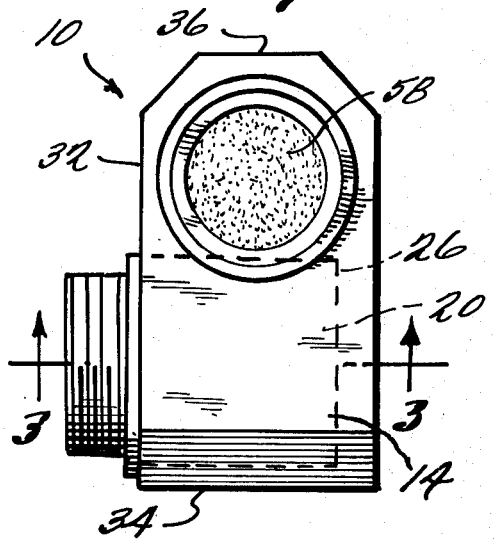
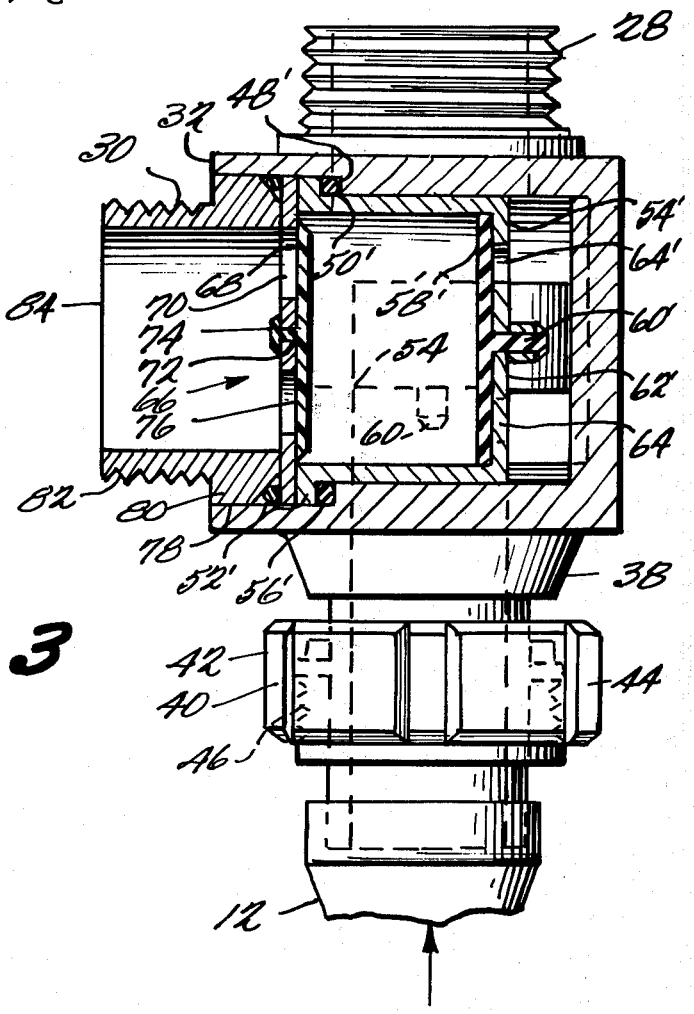
Fig. 3

CONNECTOR DEVICE FOR BREATHING APPARATUS

BACKGROUND AND SUMMARY OF THE INVENTION

The present invention relates to breathing apparatus, and more specifically, to a connecting device for use with such apparatus which will enable two or more users to draw air or gas from a single gas container.

In many emergency situations such as in fire fighting and underwater operations, self-contained, portable breathing units are advantageously employed to give the users thereof substantially enhanced freedom of movement over what would be the case if such users were required to maintain connection through a hose extension to a source of air located at a distance from a work site.

Manufacturers of self-contained breathing units have been faced with the problem of balancing both the weight and encumbrancing nature of their devices with the desirability of providing as great an air supply and, hence, working time as possible for the user of such devices. As a consequence, it has been the practice to employ rather heavy steel tanks since such tanks are able to contain air at pressures on the order of 2,000 lbs. per square inch and yet remain substantially impervious to accidental puncture as well as remain resistant to high temperatures such as are encountered in mining operations and in fire fighting. In order to extend the useful capacity of the air storage tanks, it has been the practice to rely on the use of demand regulators which, in general, employ diaphragm chambers which are supplied with air from the tanks through a combination of a control valve and reduction chamber. With such arrangements, a user can withdraw the required quantity of air from the diaphragm chamber simply by inhaling since the air in the diaphragm chamber, by suitable regulation, will be at substantially atmospheric pressure.

As a safety feature, for example where there is a malfunction in the operation of the regulating device, a number of manufacturers provide a by-pass system where gas is supplied directly from the tank to the user with the gas being at the pressure of the tank. Such an arrangement is particularly necessary in underwater operations undertaken at considerable depths where the water pressure is sufficient to render a diaphragm type device inoperative.

A number of arrangements have been proposed to permit two or more users to draw on the same compressed air supply which is a circumstance which becomes necessary where, for example, a fire fighter comes upon an individual who has been trapped in a burning building or the air supply of one individual becomes exhausted while the necessity for oxygen is still present. In the field of underground mining, where there is an ever present danger of inhaling toxic gases, the capability of supplying two or more individuals from a single compressed air source is particularly important.

It has previously been proposed to simply provide a second hook-up to a source of supply to permit a second user to draw air from a compressed air tank. However, the operation required that the gas be supplied at free flow pressure which has the disadvantage that the air supply will be rapidly expended with much of the air being wasted due to the natural inability of the users to consume the air as it is escaping at high velocity. Other proposals, which are intended to permit the second user to draw air on a demand condition through the usual regulating device, have either required the users to inhale in unison or, alternatively, one of the users is required to inhale part of the air exhaled by the primary user. This can be particularly dangerous to the second user where the second user has been deprived of oxygen before his rescue or is suffering from injury or is in shock.

The connecting device of the present invention avoids the foregoing and other difficulties experienced in the prior art and provides a connection device which can be safely and efficiently utilized to connect a second user to a single gas supply and which will permit both users to draw air through a diaphragm regulator without one of the users being forced to inhale the exhaled air from the other user.

In a preferred embodiment, the present invention employs a metal body having a hollow interior chamber and three openings in the body all of which communicate with the chamber. One of the openings is connected to the source of gas while the other two openings are provided for supplying gas to a primary and a secondary user, where two such openings are employed. The primary opening utilizes a one-way flexible check valve which permits escape of gas from the chamber either under free flow conditions or on demand through the conventional regulator. This one-way valve prohibits exhaled air from being blown back into the chamber of the connecting device. The second and each subsequent opening are provided with a pair of valve means one of which is manually openable upon connection to the air conduit of the second user while the other valve means may be the same type of one-way check valve as is used in the first or primary opening.

With the connection device of the present invention, it will be possible for multiple users of a single gas source to draw air under regulated conditions without being subjected to inhaling each other's exhaled air. In addition, the connection device permits a single user to draw air either through the diaphragm regulator or under free flow conditions while permittIng a second user to quickly attach his hose to the connection device without interrupting air to the primary user.

The foregoing and other advantages will become apparent as consideration is given to the following detailed description and accompanying drawings, in which:

BRIEF DESCRIPTION OF THE DRAWINGS

FIG. 1 is a front view in elevation of the connector device of the present invention;

FIG. 2 is a top plan view of the connecting device of FIG. 1;

FIG. 3 is a view taken along lines 3—3 of FIG. 2;

DETAILED DESCRIPTION OF THE INVENTION

Figure 4:
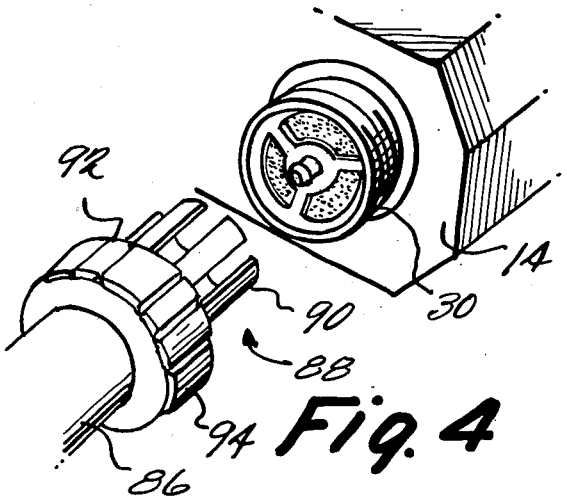
FIG. 4 is a perspective view of the hose connection for the second user.

Referring now to the drawings, where in like numerals designate corresponding parts throughout the several views, there is shown in FIGS. 1–3, the connector device of the present invention generally designated at 10. As previously discussed, the illustrated device 10 is used to distribute gas to two users from a common source of supply which is connected to the device 10 through a hose 12 of conventional construction. For this purpose, device 10 consists of a body 14 of suitable material such as an aluminum block into which may be drilled three bores 16, 18 and 20. Each of the bores 16 through 20 are of sufficient diameter and depth so as to intersect to define the hollow chamber 22 within the body 14 so that each of the bores 16, 18 and 20 will define openings in the body communicating with the chamber 22.

To facilitate cooperation with conventional breathing units, it is preferable that the gas supply be introduced to the chamber 22 through the bottom side 24 of the body 14 and that the primary user withdraw gas from the chamber 22 through the top side 26 whereby a hose (not shown) attached to the threaded connecting cylinder 28 may extend directly to the mask of the primary user without being subjected to any contortions or twisting. Also, to facilitate connection by a secondary user, it is preferable to locate the connection means 30 of the secondary opening on the front face 32 of the body 14.

As will become apparent from the description of the operation of the device 10, a manufacturer may easily modify the illustrated body 14 to accommodate two additional secondary users by, for example, drilling bores into sides 34 and 36 of the body 14 to an extent such that the bores will communicate with the chamber 22 and thus be in communication with the gas supplied through the hose 12 to the chamber 22. Additionally, it will be readily understood by those skilled in this art that the size of body 14 can be enlarged, for example, by extending the distance between sides 36 and 34 whereby any desired number of secondary openings can be formed simply by drilling bores similar to bore 20 into the front face 32 of the body. Such devices would have particular use in underground mining operations where it is a normal circumstance to have several individuals working in a confined area which, in an emergency, could then be supplied by air from a single hose.

As mentioned above, the bottom side 24 of the body 14 preferably has formed in it the bore 18 which is the opening through which gas from a source under pressure is supplied. For this purpose, a conical shoulder 38 is formed integrally with surface 24 and extends substantially perpendicularly therefrom. At one end of the shoulder 38 a retaining gasket 40 is positioned for the purpose of holding an interiorly threaded female connector 42 which is freely rotatable about the shoulder 38 between the gasket and an abutment as at 44.

Figure 6:
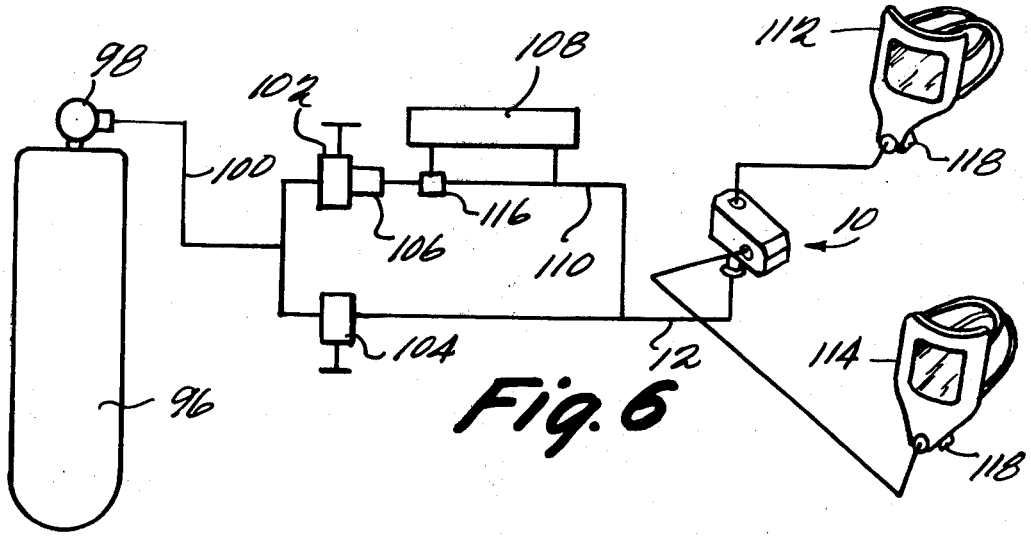
FIG. 6 is a schematic illustration of an air supply system using the connector device of the present invention.

A fluid-tight connection is established by threading a threaded male connector 46 into the female connector 42 until the male connector abuts the retaining gasket 40. Opposite the threaded end of the male connector 46, there is secured, in a conventional manner at one end a rubber hose 12. The other end of the rubber hose, as illustrated more clearly in FIG. 6, is connected to the outlet of the regulating device of the breathing unit.

Turning now to a description of the primary opening for supplying air to the primary user, bore 16 has the upper portion thereof of wider diameter to provide a shoulder 48. A cup member 50 is inserted into bore 16 so that the flange 52 of the cup rests on the shoulder 48 thus limiting the depth of insertion of the cup into the bore 16. As a result, the bottom 54 of the cup 50 will be spaced a predetermined distance from the bottom of the bore 16, whereby the gas or air coming from the bore 18 will be able to flow freely into bore 16.

Suitably dimensioned O-rings or gaskets may be employed about the exterior of the cup 50 as at 56 to provide a fluid-tight seal between the exterior of the cup 50 and the bore 16.

The bottom 54 of the cup 50 carries the valve means, which, in a preferred embodiment, is in the form of a normally flat, flexible, rubber disc 58 which has a projection 60 fastened in an aperture 62 formed in the bottom 54. Also, the bottom 54 is provided with a plurality of radially spaced apertures as at 64 which serve as air passages and which are covered by the disc 58 when the disc is in its unflexed condition. In this embodiment, the dimensions of disc 58 are such that it completely occupies the bottom surface of the interior of the cup 50.

With this arrangement, gas flow is permitted to enter the cup 50 through the apertures when there is a pressure differential existing across the disc 58 which is the case when the primary user inhales creating a partial vacuum within the cup 50 which will cause the flexible disc 58 to move upwardly as viewed in FIG. 3 off of the apertures 64 when air is being supplied to the chamber 32 from a source of supply.

The cup 50 is retained in bore 16 by the threaded connecting cylinder 28 which is press fitted into the mouth of the bore 16 until it rests on the flange 52 of the cup 50.

The valve means for the secondary opening, bore 20 will now be described.

As previously mentioned, bore 20 carries valve means for controlling the supply of air to the secondary user. To this end, bore 20 has a first valve means which, in a preferred embodiment, is identical to the valve means carried in bore 16 the elements of which are designated by the primed numerals in FIG. 3 corresponding to the unprimed elements of the valve arrangement for bore 16. Specifically, bore 20 has a counter-bore at its mouth for the purposes of providing a shoulder 48′ on which rests the flange 52′ of a cup 50′. The usual O-ring as at 56′ may be suitably interposed between the flange 52′ and the shoulder 48′ for the same purposes as described above. The bottom 54′ of the cup 50′ is identical to that described above and thus has the same dispositions of a central aperture 62′ and radially disposed air passage apertures 64′. The flexible valve disc 58′ is similarly attached to the bottom through a projection 60′ disposed in apertures 62′. Thus, the flexible valve disc 58′ is capable of operating in the same manner as valve disc 58 when a differential pressure exists across the valve disc 58′.

In accordance with the present invention, connection means 30 differs from the threaded connecting cylinder 28 which is fitted into the mouth of bore 16 in that connection means 30 holds a second valve means 66 on a plate member 68 which is disposed between the flange 52′ and the bottom of the connection means 30 in the bore 20. The plate member 68 serves the same functions as the bottoms of the cups 50 and 50′ in that it is formed with the plurality of apertures 70 which serve as air passages and a central aperture 72 which receives a projection 74 of a flexible disc member 76 which, preferably, is identical to the previously described flexible discs 58 and 58'. Preferably there are three apertures 70 formed in plate member 68 as shown in FIG. 1 to facilitate insertion of a penetrating means described below. It will be noted that the flexible disc 76 is disposed on the interior of the connection means 30 and thus serves to prevent flow of gas out of the bore 20 in the event that gas passes valve disc 58'. In the assembled condition, the tapered base 78 of connection means 30 is press fitted into the counterbore of bore 20 to close off bore 20. A suitable gasket ring 80 may be employed to serve as a seal between the lower face of the connection means 30 and the flange 52' of cup 50'.

A second reduced diameter threaded portion 82 is provided on connection means 30 for the purposes of receiving a sealing cap (not shown) to close the mouth 84 of the connection means 30 as well as to establish connection with a threaded ring mounted on a hose and as described below.

Figure 5:
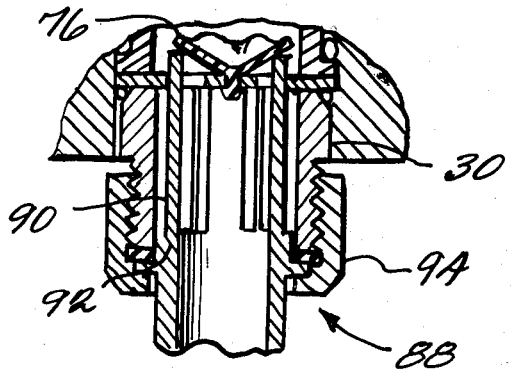
FIG. 5 is a sectional view with parts broken away of the hose connection of the second user.

With reference now to FIGS. 4 and 5, there is illustrated the manner in which a second user connects his air hose 86 to the connection means 30 of the second opening of body 14. The end of hose 86 is provided with a penetrating means of which is in the form of a member having six fingers, one of which is indicated at 90. The fingers 90 are of a size and shape to pass through the three apertures 70 in the plate member 68. Additionally, the fingers 90 are radially curved and extend a sufficient distance from their base 92 so that when ring member 94 is threaded onto the threads 82 of the connection means 30, the fingers 90 will penetrate through the apertures 70 and bend the disc member 76 away from the apertures 70. As a result, air or gas under pressure will be permitted to flow out of the cup 50' assuming that there is a differential pressure existing across the first valve disc 58' as explained above.

PreferablY, each of the flexible discs 58, 58' and 76 are made of rubber, so that, due to the natural resiliency, these discs will tend to remain in a flat, planar condition. It will be clear then, that when the hose 86 is disconnected from the connection means 30, the disc member 76 will unflex to close the aperture 70 and thus cut off flow of air out of the bore 20.

Turning now to FIG. 6, there is schematically illustrated a diagram of a conventional breathing apparatus wherein the original gaseous source is an air tank 96. It should be understood that the term "gas" as used in the specification, is intended to describe both compressed air as well as oxygen or any mixture of breathable gases.

The air tank 96 has the conventional supply valve and gauge 98 at its mouth from which air is passed through suitable tubing 100 to both a normal operation valve 102 or a by-pass valve 104.

The normal operation valve is conventionally a reduction valve which feeds to a reduction chamber 106 so that air passed to the diaphragm chamber 108 will be delivered at a substantially reduced pressure than that which exists in the tank 96. Conventionally, the gas in the tank 96 will be stored at pressures on the order of 2,000 p.s.i. whereas the air delivered to the diaphragm chamber is preferably at substantially atmospheric pressure.

As is well known, the diaphragm chamber 108 is provided with a flexible partition dividing the chamber into two zones, one of which is exposed to atmospheric pressure external to the breathing unit while the other zone receives air from the reduction chamber 106. Through suitable tubing as at 110, gas or air from the diaphragm chamber is presented to the connection device 10 of the present invention through the hose 12. As shown in FIG. 6, two face masks 112 for the primary user and 114 for the secondary user, are shown connected to the connection device 10 of this invention.

All of the valves of the breathing unit of FIG. 6 are conventionally manually operated so that a user can obtain air from the diaphragm regulator when valve 104 is closed and valve 102 open which is a demand type situation corresponding to normal atmospheric breathing. This is effected since the air in the diaphragm zone chamber 108 will be drawn off by a user by simply inhaling which will effect a partial collapse of the diaphragm. Such collapsing will open a resupply valve 116 thus causing reinflation of the diaphragm chamber. Under some circumstances, such as malfunction of the regulation system, it may be necessary or desirable to supply air to the user under a free flow or high pressure condition. This is effected by closing valve 102 and opening valve 104 whereby gas or air from the tank 96 substantially at the tank pressure will be delivered to the user.

With the foregoing alternative methods of operating the conventional breathing unit in mind, the operation of the connection device 10 of the present invention will now be explained in connection with FIG. 7.

Figure 7:
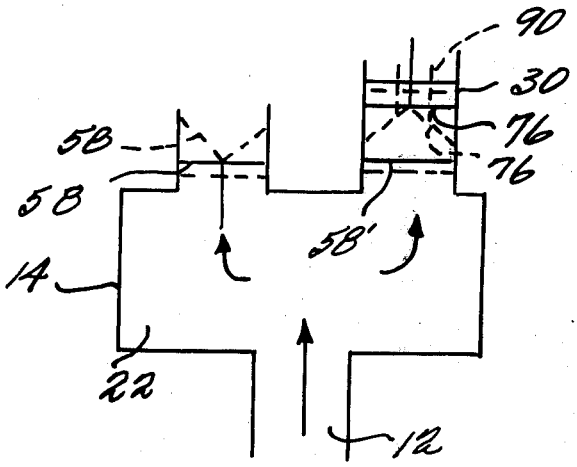
FIG. 7 is a schematic illustration of the air flow paths possible through the connector device of the present invention.

Referring to FIG. 7, there is schematically illustrated the possible flow paths through the chamber 22 of the body 14 of the present invention. With valves 98 and 102 of the breathing unit of FIG. 6 opened, gas at substantially atmospheric pressure will be delivered to chamber 22 through hose 12. Assuming the air in the tubing leading from the disc 58 to the mask is under atmospheric pressure, the disc 58 will remain in its flat condition thus closing off flow of gas from the chamber 22 to the mask 112. However, when the user inhales there will be a pressure drop in the tubing between the mask and disc 58 so that the atmospheric air in chamber 22 will push against the disc 58 and move momentarily to the dotted line position as long as the user is inhaling. At the end of taking a breath, the disc will close in response to the user exhaling so that substantially no exhaled air will be moved into chamber 22. However, as conventional, the masks are provided with normal exhaust valves as at 118 (FIG. 6).

When free flow conditions are required, corresponding to the user closing valve 102 and opening valve 104, air at superatmospheric pressure will exist in chamber 22 to maintain valve disc 58 open as long as the free flow condition persists or until the supply of air at aboveatmospheric pressure is expended.

It will be noted, that with the present invention, where a second user is not connected to the device 10 and free flow conditions are being employed by the primary user, disc valve 76 will prevent escape of air through the secOndary user's connection means 30 since the superatmospheric pressure existing in chamber 22 will maintain the flexible disc 76 in a flat position closing the apertures in the plate member 68. With this arrangement, it is unnecessary to use a sealing cap on the mouth of the connection means 30 so that the loss of air when a connection must be established through this opening is minimized by the elimination of the necessity of repeatedly threading and unthreading a cap.

Assuming valve 102 is open and valve 104 closed and a secondary user is connected as described above with connection means 30 valve disc 76 will be maintained off of the apertures 70 by the fingers 90 of the penetrating device 88. Thus valve disc 58' will operate in the same manner as valve disc 58 and both of these valve discs will prevent either user from inhaling the exhaled air of the other.

Under free flow conditions, both valves 58 and 58' will remain open due to the high pressure that will exist in chamber 22 yet also due to the high velocity flow, no exhaled air will be able to reach chamber 22.

It will be obvious to those skilled in this art that numerous modifications may be made in the details and arrangement of parts of this invention without departing from the spirit and scope thereof as defined in the appended claims.

What is claimed is:

1. In a breathing apparatus including a container for gas under pressure, a regulating device connected to the container, said regulating device having means for supplying gas at atmospheric pressure on demand and means for supplying gas at the container pressure, at least one face mask having an exhaust valve and a conduit connected to the face mask for supplying gas thereto, the improvement comprising:

a connector device including a body having a chamber therein, a first opening in said body communicating with said chamber, said first opening having means for establishing a fluid tight connection with said regulating device, a second opening in said body also communicating with said chamber, said second opening having an apertured wall extending across said second opening and flexible disc valve means mounted on said apertured wall for permitting escape of gas from said chamber through said apertured wall in response to the presence of a lower pressure existing externally of said body relative to the pressure in said chamber, but preventing passage of gas through said second opening into said chamber, said second opening having means for establishing a connection with said conduit connected to said face mask, a third opening in said body also communicating with said chamber, said third opening having at one end thereof a first apertured wall extending there across and a second apertured wall located at a distance from said first apertured wall and closer to the external end of said third opening, said first apertured wall having flexible disc valve means mounted thereon for permitting escape of gas from said chamber to said second apertured wall, but preventing passage of gas from the exterior of said body into said chamber, said second apertured wall of said third opening having flexible disc valve means mounted thereon and movable between a closed position wherein escape of gas from said chamber through said first apertured wall of said third opening is prevented and an open position wherein escape of gas therethrough from said chamber and through said first apertured wall and flexible disc valve means mounted thereon is permitted.

2. The device as claimed in claim 1 wherein said first, second and third openings are bores formed in said body, one of said bores having a portion thereof intersecting the other two bores to define a portion of said chamber.

3. The device as claimed in claim 1 wherein said openings are each bores formed in said body and said second opening includes a cup member disposed in said bore defining said second opening, said apertured wall of said second opening being the bottom wall of said cup member, said bore defining said second opening having a bottom wall and said cup member having its apertured wall spaced a distance from said bottom wall of said bore of said second opening, said flexible valve means of said second opening being carried on said apertured wall on the interior of said cup member.

4. The device as claimed in claim 3 wherein said third opening includes a cup member disposed in said bore defining said third opening, said cup member having at its bottom wall said first apertured wall spaced a distance from the bottom wall of said bore defining said third opening, said flexible disc valve means on said first apertured wall being mounted on the interior of said cup member in said third opening.

5. The device as claimed in claim 4 wherein said second apertured wall of said third opening includes an apertured plate member, said cup in said third opening having a mouth with a rim, said plate member being disposed adjacent said rim, said bore defining said third opening having a mouth and a threaded portion adjacent said mouth, a threaded connection member threaded into said mouth of said third opening in engagement with said plate member, said plate member having an interior surface facing the interior of said cup member in said third opening, said flexible disc valve means of said second apertured wall being fixed to said interior surface of said plate member.

6. The device as claimed in claim 5 wherein sealing means are disposed about said rim of said cup member.

* * * * *